US006195834B1

(12) United States Patent
Shteingold

(10) Patent No.: US 6,195,834 B1
(45) Date of Patent: Mar. 6, 2001

(54) METHOD AND APPARATUS FOR REMOVING FOREIGN PARTICLES

(76) Inventor: David Shteingold, 160 Neptune Blvd., #307 W., Lynn, MA (US) 01905

( * ) Notice: Subject to any disclaimer, the term of this patent is extended or adjusted under 35 U.S.C. 154(b) by 0 days.

(21) Appl. No.: 09/276,036

(22) Filed: Mar. 25, 1999

(51) Int. Cl.[7] ..... A47L 5/14
(52) U.S. Cl. ..... 15/311; 15/305; 15/345
(58) Field of Search ..... 75/345, 305, 311

(56) References Cited

U.S. PATENT DOCUMENTS

| | | | | |
|---|---|---|---|---|
| 3,568,477 | * | 3/1971 | Dixon et al. | 15/305 X |
| 3,592,689 | * | 7/1971 | Chaplinski | 15/305 X |
| 3,612,076 | * | 10/1971 | Brahm | 15/305 X |
| 3,733,639 | * | 5/1973 | Timian | 15/311 X |
| 4,037,290 | | 6/1977 | Rose . | |
| 4,058,868 | * | 11/1977 | Champion | 15/305 X |
| 4,174,204 | | 11/1979 | Chase . | |
| 4,300,261 | | 11/1981 | Woodward . | |
| 4,333,205 | | 6/1982 | Woodward . | |
| 4,403,369 | * | 9/1983 | Lin | 15/311 X |
| 5,400,466 | | 3/1995 | Alderman . | |
| 5,454,137 | | 11/1995 | Reeves . | |
| 5,480,030 | | 1/1996 | Sweeney . | |
| 5,531,862 | | 4/1996 | Otsubo . | |
| 5,603,775 | | 2/1997 | Sjoberg . | |
| 5,647,092 | | 4/1997 | Miwa . | |
| 5,849,135 | | 12/1998 | Selwyn . | |

* cited by examiner

*Primary Examiner*—Chris K. Moore
(74) *Attorney, Agent, or Firm*—Boris Lechinsky

(57) ABSTRACT

A method and an apparatus for removing foreign particles such as dust from an object of complex shape is disclosed. An object is placed in an enclosed chamber and agitated by mechanical vibration means and by pulsed air jets while rotating, all to separate the dust particles from that object. Periodic injection of compressed air causes the dust particles to be suspended in that air and subsequently removed when the air is aspirated. The method and an apparatus can be used in combination with a household vacuum cleaner for cleaning of large household items such as clothing, pillows, linens, etc. In industrial use, the method of invention can be used for cleaning of electronic components from foreign particles.

6 Claims, 1 Drawing Sheet

METHOD AND APPARATUS FOR REMOVING FOREIGN PARTICLES

BACKGROUND OF THE INVENTION

1. Field of the Invention

The present invention relates generally to cleaning devices similar to vacuum cleaners for removal of foreign particles such as specs of dust, contaminants and alike for in-house or industrial use. More particularly, the method of the present invention describes a cleaning process combining mechanical agitation and pulsed air flow as used for cleaning purposes.

2. Description of the Prior Art

Vacuum cleaning and other methods of removing of dust and other foreign particles are well known in the prior art. Various methods of dust removal were suggested in the past for use in the industrial as well as in-house environment.

Combining the effects of dust agitation from the compressed constant flow air jets with evacuating the air containing dust specs from an enclosed chamber for use as carpet cleaning means in household vacuum cleaners is described in many U.S. patents. Examples of such patents include U.S. Pat. No. 5,647,092 by Miwa; U.S. Pat. No. 5,603,775 by Sjoberg; U.S. Pat. No. 5,454,137 by Reeves; U.S. Pat. No. 4,300,261 by Woodward; and U.S. Pat. No. 4,037,290 by Rose. These patents typically describe various attachments to a commonly used household vacuum cleaner containing a chamber or a shroud placed over a carpet section to be cleaned and having provisions for supplying air jets at a constant flow rate to agitate the fibers of the carpet and to separate the dust particles therefrom. Vacuum hose is used to evacuate the air filled with these suspended dust particles and thus the carpet or a section of the floor is cleaned. Among the limitations of these relatively simple designs, those skilled in the art can point to the limited ability of the constant flow air jets to lift the dust particles and also the inability of these attachments to clean large objects of complex shape, such as a pillow, pieces of clothing, or bed linens due to the limitations of the volume and design of the enclosing chamber. The chamber according to these US patents is typically opened from one end and assumes an available flat surface of the object to be cleaned to form a complete enclosure in combination with that object.

An electrically operated transducer producing agitating waves where this transducer being incorporated in a vacuum cleaner suction head is described in the U.S. Pat. No. 5,400,466 by Alderman. The use of the transducer instead of the air jets is suggested for better and simpler agitation of the dust particles. This design suffers from similar limitation, namely the inability to clean larger objects with complex geometry.

Vacuum cleaners of the prior art are also known to use pulsed air flow as agitation means. Examples of the use of pulsed or reversed direction air flow are contained in U.S. Pat. No. 4,333,205 by Woodward and U.S. Pat. No. 4,174,204 by Chase. In addition to the same limitation of the size and volume of the objects to be cleaned, these designs are quite complex and may have limited reliability.

The use of a large elastic bag for storing and cleaning of large household items made of fabric is known from the U.S. Pat. No. 5,480,030 by Sweeney describing a storage enclosure with provisions for evacuating air. Another example is described in a manual to the vacuum cleaner produced by Rexair, Inc. (Troy, Mich.) describing the use of a large bag ("AEROFRESH BAG") containing pieces of clothing or linen and a manual procedure for the use of an upholstery tool to evacuate the dusty air from the bag. This description does not contained provisions for agitating the item to be cleaned nor suggests repeating of the process at least several times and thus is limited in its efficiency.

Finally, effective dust removal is an important part of the manufacturing process for many industries, especially for the electronics industry. Mechanical vibration coupled with plasma blowing over electronic components is a suggested method of cleaning according to U.S. Pat. No. 5,531,862 by Otsubo and U.S. Pat. No. 5,849,135 by Selwyn. These patents propose the use of a totally enclosed chamber equipped with a mechanical agitator for separating the foreign particles from the object to be cleaned, such as semiconductor components. In addition to a complex nature of these devices, constant plasma flows are suggested which limits the efficiency of the process of cleaning.

Therefore, the need exists for a simple method and apparatus capable of efficient separating and removing the dust particles from an object of complex shape.

SUMMARY OF THE INVENTION

Accordingly, it is an object of the present invention to overcome these and other drawbacks of the prior art by providing a method and an apparatus for removal of foreign particles combining efficient agitation and dust removal techniques.

It is another object of the present invention to provide a method and an apparatus for cleaning of objects of large size or complex shape, such as pieces of clothing, linens, pillows, or other similar household items that can not be cleaned otherwise by a common household vacuum cleaner.

It is a further object of the invention to provide a method and an apparatus for removal of foreign particles from electronic components such as computer boards and alike as part of the manufacturing process thereof.

The apparatus for removal of foreign particles comprises an enclosed chamber equipped with agitation means such as pulsed air jets, mechanical vibrator or a combination thereof. Air supply and removal means are connected to the chamber via valve means for periodic injection and aspiration of air from the chamber.

According to the method of the invention, an object to be cleaned is placed in the chamber and subjected to agitation for initial separation of foreign particles. Air is periodically injected and removed from the chamber for both additional blowing off the particles as well as for carrying out the particles of dust suspended in the air. This process may be repeated at least three times for complete cleaning of the object. For a household application, the use of a common vacuum cleaner is suggested for the purposes of removing the air containing dust particles. Adjustment means are envisioned for tuning the frequency and duration of air removal cycles.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

A detailed description of the present invention follows with reference to accompanying drawings in which like elements are indicated by like reference letters and numerals.

Figure 1:
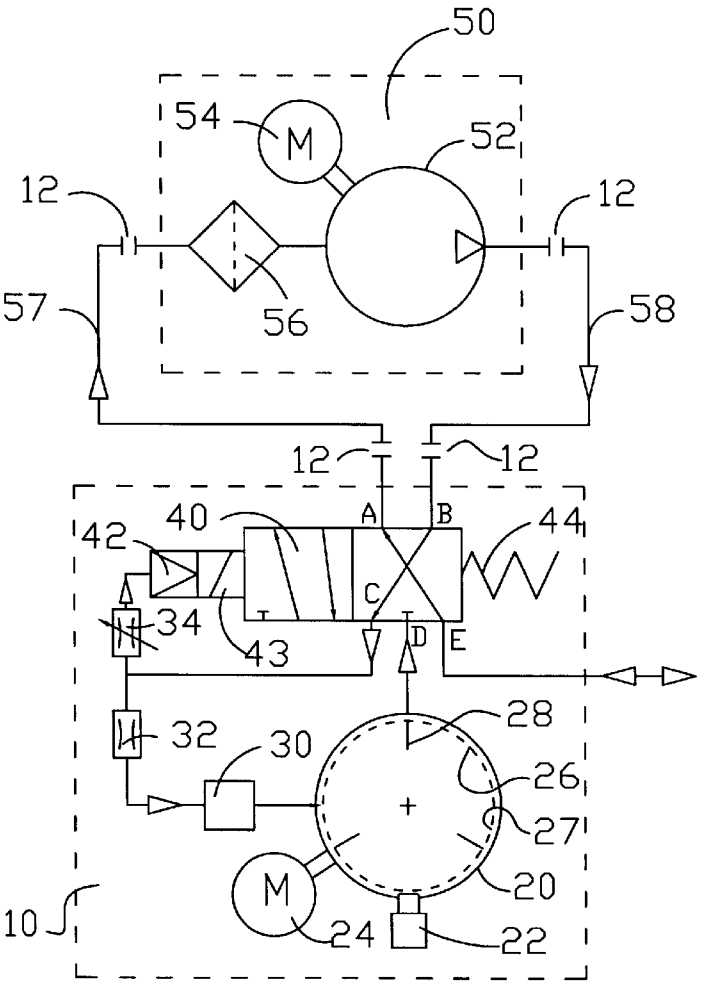
FIG. 1 is a schematic view of the apparatus of the present invention.

Reference is now made to FIG. 1 of the drawings where the schematic view of the apparatus is presented as a combination of the particle removal device (10) and an air pumping device (50) connected together with two air flow conduits—conduit (57) for moving air from device (10) to device (50), and conduit (58) for moving air from device (50) to device (10). Optional quick disconnect couplings (12) may be used for easy assembly and disassembly of the apparatus if needed for convenient storage.

Particle removal device (10) comprises a chamber (20) for placement of the object to be cleaned. According to the preferred embodiment of the invention, this cylindrical chamber contains a rotating drum (26) with optional protrusions (28) driven by a motor means (24) and having perforations (27) along its walls for air to enter and exit the inside space of the drum. Opening and closing means are envisioned (not shown) to allow the object to be placed into and removed from the inside of the drum (26). Vibration means (22) are positioned to agitate the drum (26) while 9 rotating to further separate the foreign particles from the object to be cleaned. Vibration means (22) can be of any commonly known design, for example can be a rubber cam rotating on an electrical motor (not shown on the schematic drawing). While the motor is attached to the housing, the rubber cam is positioned in the vicinity of the rotating drum so that every revolution of the cam causes agitation of the drum.

Air supply and removal system contains a 2-position 5-way valve (40) having two inlets (A) and (B) and three outlets (C ), (D), and (E). Inlet (A) is connected to the intake port of the air pumping device (50), while inlet (B) is connected to the air output port of the same device (50). Outlet (C ) is connected to both an air pulsator means (30) through a dampening restrictor (32) and, at the same 20 time to the control means (42) of the valve (40) through an adjustable throttle (34). Output (D) is connected to the exhaust of the chamber (20). Output (E) is opened to atmosphere or, in case of using gases other than air, to the source of that gas.

Valve (40) is a two-position, five port valve. It is equipped with a return spring (44) and a solenoid means (43). Activation of solenoid means (43) causes the valve (40) to shift its position. Deactivation of the solenoid means (43) causes the return spring (44) to shift the valve (40) back to its initial position shown on FIG. 1. Pressure chamber (42) is designed to control the process of activating and deactivating of solenoid means (43) and therefore the position of the valve (40). It contains a pressure sensor (not shown). Once the air pressure has reached a predetermined level such as for example 10 psi, as detected by the sensor, the solenoid means (43) are activated. As the air pressure drops below another predetermined level such as for example minus 5 psi or even an atmospheric pressure, the pressure sensor sends a signal to deactivate the solenoid means (43) to complete the working cycle of the valve. The above described design of the valve is well known to those skilled in the art of solenoid pneumatically controlled valves. It should be understood here that other similar designs can be used for this purpose as well.

Figure 2:
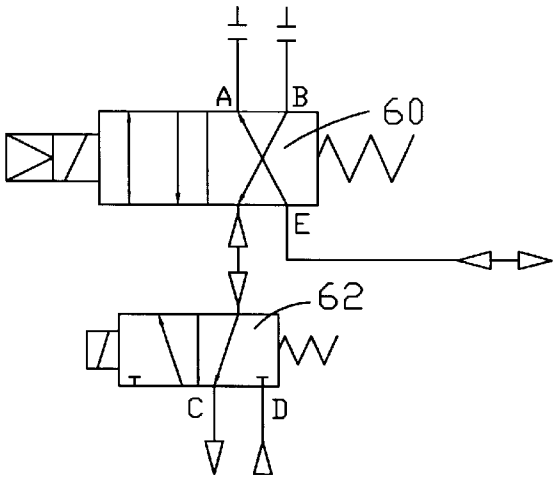
FIG. 2 is a schematic view of the alternative arrangement for the valve means of the invention.

Those skilled in the art would readily appreciate that other configurations of valve means can be used for the apparatus of the present invention as long as they provide the same function as the valve (40). An example of one such arrangement is shown on FIG. 2 where a combination of a 2-position 4-way valve (60) with a 2-position 3-way valve (62) can be used with the same ports (A) through (E) as described above.

Air pumping device (50) contains an optional intake filter (56), and an air compressor (52) driven by a motor (54). A common household vacuum cleaner can be used as an air pumping device (50) if the method of the invention is practiced for a household use.

In operation, initially the air pressure is low and the valve position is the one illustrated on FIG. 1. The object to be cleaned is placed in the drum (26) of the chamber (20) and the power is turned on. Motor (24) drives the rotating drum (26) while the vibration means (22) cause the agitation of the object and therefore the separation of the foreign particles therefrom. Air pumping device (50) is pumping air from atmosphere through the outlet (E) to the inlet (A) and further through the conduit (57) and the filter (56) into the air compressor (52). Compressed air leaves the device (50) through the conduit (58) into the inlet (B) of the valve (40), and further from the outlet (C ) it separates in two directions: first, the compressed air travels through the dampening restrictor (32) into the air pulsator (30), and second, it travels through the adjustable throttle (34) to the pressure control chamber (42) of the valve (40). Outlet (D) and thus the exhaust port of the chamber (20) are closed. Air pulsator (30) emits high frequency pulses of compressed air which enter the chamber (20) and further enter the drum (26) through the perforations (27). These pulsed air jets are utilized for more effective separation of particles from the object to be cleaned. Note that compressed air is injected into a fixed volume chamber (20) while its outlet (port D) is closed. As this air enters the low pressure cavity of the rotating drum (26) from around the higher pressure periphery of the chamber (20) through the perforations (27), air jets are formed which further increases the efficacy of the dust removal process. In this situation, the air pressure is rising in a stepped manner inside the chamber (20) as more and more air is injected through a pulsator (30).

At the same time, pressure is rising in the control pressure chamber (42). The rate of the rise in pressure is controlled by the throttle (34) which can be adjusted to achieve longer or shorter duration of the cycle. Once the air pressure has reached the predetermined level, the solenoid means (43) are activated and the valve (40) is shifted to the opposite position. This marks the end of the air injection part of the air cycle.

Once the valve (40) is shifted, the air aspiration portion of the cleaning cycle begins. The intake port of the air pumping device (50) is connected via the inlet (A) to the outlet (D) of the valve (40) and therefore to the exhaust port of the chamber (20). Air starts to flow out of the chamber and into the filter (56) of the air pumping device (50). Note that air is leaving the pressurized fixed volume chamber (20) while its inlet is closed. As a result, the pressure in the chamber (20) is being reduced possibly even to negative values so that the air contaminated with dust particles is removed from the vicinity of the article to be cleaned. It is therefore the periodic fluctuations of air pressure coupled with inflow and aspiration of air into and from the fixed volume chamber (20) which provides for the separation and removal of the dust particles from the article to be cleaned. The dust particles are separated in the filter (56) and the clean air is pumped through the conduit (58) into the inlet (B) and further through the outlet (E) to atmosphere.

At the same time, the pressure in the control pressure chamber (42) is falling due to the slow bleeding of air from that chamber through the throttle (34), restrictor (32), pulsator (30) and into the chamber (20). Once the pressure is below a predetermined level, the solenoid means (43) is turned off, the spring (44) returns the valve (40) into initial position and the cycle repeats itself. It is suggested to have at least three cycles for a complete cleaning of the object in the chamber (20) but a higher or lower number of cleaning cycles are also contemplated. The frequency of valve (40) shifting is controlled by the throttle (34). The restrictor (32) is needed to isolate the throttle (34) from the pulsator (30).

Other applications of the invention are envisioned in addition to the household use. In electronics industry, for example, the method of the invention can be used for cleaning of sensitive electronic components. In that case, gases other than air, such as inert gases or plasma, can be used to blow off and remove the foreign particles. Other appropriate modifications have to be implemented as can be appreciated by those skilled in the art, such as the design of the chamber and the vibrating means.

Another variation envisioned for this invention is to make the chamber having not fixed but adjustable volume. Fixed volume chambers can be used for cleaning of items where periodic pressurization of the object provides for better dust separation. For other items, inflatable chambers are preferred because that would increase the volume of the injected air and thus provide for more aggressive air pulse jets. The advantage of an inflatable chamber is that its volume is not fixed as was described above, but is in fact variable. Any commonly known variable volume chambers such as bellows, elastic chambers and alike can be used for this purpose as long as they allow more air to enter during the pressurization portion of the cleaning cycle.

Although the present invention has been described with respect to a specific embodiment and applications, it is not limited thereto. Numerous variations and modifications readily will be appreciated by those skilled in the art and are intended to be included within the scope of the present invention, which is recited in the following claims.

I claim:

1. An apparatus for removing foreign particles from an object, said apparatus comprising:

an enclosed chamber for containing the object, said chamber having an inlet port and an exhaust port;

a vibrating means attached to said chamber, said vibrating means separating said foreign particles from the object by conveying an agitation motion through said chamber to the object contained therein;

a gas pumping means for causing a gas flow, said gas pumping means having an intake port and an output port;

a valving means having first, second, third, fourth, and fifth ports, the first port connected to the intake port of said gas pumping means, the second port connected to the output port of said gas pumping means, the third port connected to the inlet port of said chamber, the fourth port connected to the exhaust port of said chamber, the fifth port connected to a source of gas, and a control means for periodic shifting of said valving means between a first position and a second position; the first position characterized by having the first port connected to the fifth port, the second port connected to the third port, the fourth port being closed; the second position characterized by having the first port connected to the fourth port, the second port connected to the fifth port, the third port being closed, whereby said foreign particles are removed from said chamber while suspended in said gas when said valving means are in said second position.

2. An apparatus as in claim 1, wherein said gas being air, said fifth port being vented to atmosphere.

3. An apparatus as in claim 1, wherein said gas pumping means further comprising a filter for removing said foreign particles from said gas.

4. An apparatus as in claim 1 further comprising a gas pulsator for emitting high frequency gas pulses, said pulsator an inlet connected with third port of said valving means and an outlet connected with the inlet port of said chamber.

5. An apparatus as in claim 1, wherein said chamber further comprising a rotating drum therein for tumbling of the object placed within said drum.

6. An apparatus as in claim 5, wherein said rotating drum having a plurality of perforations.

* * * * *